United States Patent [19]

Newkirk et al.

[11] 4,110,227

[45] Aug. 29, 1978

[54] OXIDATION STABLE POLYOXYALKYLENE FIBER LUBRICANTS

[75] Inventors: David Dudley Newkirk; Robert Bernard Login, both of Woodhaven; Basil Thir, Wyandotte, all of Mich.

[73] Assignee: BASF Wyandotte Corporation, Wyandotte, Mich.

[21] Appl. No.: 834,721

[22] Filed: Sep. 19, 1977

[51] Int. Cl.[2] ..... D06M 13/10

[52] U.S. Cl. ..... 252/8.9; 8/115.6; 252/8.6; 260/410.5; 428/395; 560/254

[58] Field of Search ..... 252/8.9, 8.6; 8/115.6 A; 428/395; 260/410.5; 560/254

[56] References Cited

U.S. PATENT DOCUMENTS

| | | | |
|---|---|---|---|
| 2,457,139 | 12/1948 | Fife et al. | 260/410.5 |
| 2,674,619 | 4/1954 | Lunsted | 260/485 |
| 2,677,700 | 5/1954 | Jackson et al. | 260/485 |
| 2,786,080 | 3/1957 | Patton | 262/8.9 X |
| 3,036,118 | 5/1962 | Jackson et al. | 260/484 |
| 3,146,272 | 8/1964 | Lloyd | 260/611.5 |
| 3,326,849 | 6/1967 | Kelly et al. | 260/45.8 |
| 3,446,734 | 5/1969 | Coats | 252/8.8 |
| 3,456,972 | 9/1973 | Kobayashi et al. | 260/185 |
| 3,578,594 | 5/1971 | Dombrow | 252/8.9 |
| 3,925,588 | 12/1975 | Marshall et al. | 428/395 |

FOREIGN PATENT DOCUMENTS

| | | | |
|---|---|---|---|
| 51-70,397 | 1976 | Japan | 8/115.6 A |
| 1,460,960 | 1/1977 | United Kingdom | 8/115.6 A |

*Primary Examiner*—William E. Schulz

*Attorney, Agent, or Firm*—Andrew E. Pierce; Bernhard R. Swick; Robert E. Dunn

[57] ABSTRACT

Lubricants for synthetic fibers such as polyester and nylon are disclosed which are improved oxidation stable polyoxyalkylene lubricant compounds. Such lubricant compounds can be used alone as textile fiber lubricants or in combination with other polyoxyalkylene compounds useful as fiber lubricants but which are subject to oxidative degradation under conditions of heating at temperatures at least above 200° C. An improved textile fiber is produced by the use of such fiber lubricants in conventional processes for producing continuous filament, false twist, textured yarn as well as other type yarns.

The improved oxidation stable homopolymer and copolymer, i.e., block or heteric polyoxyalkylene lubricant compounds have the formulas:

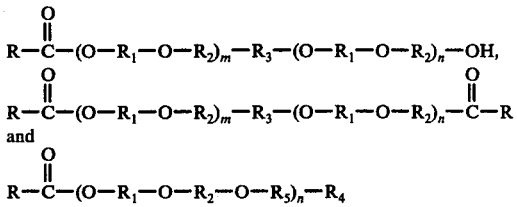

I.

II.

and

III.

and can be used alone or in mixtures or in a mixture of an effective proportion thereof of at least 25% by weight based on the total weight of the mixture with one or more of any prior art polyoxyalkylene fiber lubricant compounds but preferably with one or more polyoxyalkylene compounds selected from the group consisting of prior art compounds having the formulas:

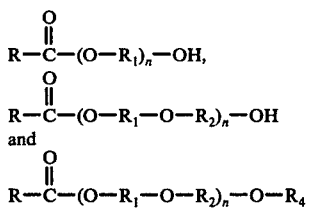

IV.

V.

and

VI.

R is individually selected from alkyl groups of 1 to about 21 carbon atoms preferably about 7 to about 21 carbon atoms and most preferably about 12 to about 18 carbon atoms.

In lubricants I, III, V and VI, $R_1$ and $R_2$ are the residue of the same or different alkylene units and in lubricant II, $R_1$ and $R_2$ are different alkylene units, all individually selected from the group consisting of the residue of ethylene oxide, propylene oxide, butylene oxide and an aromatic glycidyl ether, $R_3$ is the residue of a difunctional phenol, $R_4$ is hydrogen, an acyl or alkyl group and where alkyl, derived from an aliphatic monofunctional alcohol having 1 to about 21 carbon atoms, preferably about 4 to about 18 carbon atoms and most preferably about 4 to about 12 carbon atoms or where acyl derived from an aliphatic monocarboxylic acid of 2 to about 21 carbon atoms, preferably about 4 to about 18 carbon atoms and most preferably about 6 to about 12 carbon atoms, $R_5$ is the residue of an aromatic glycidyl ether, preferably a phenyl glycidyl ether and $n$ or $m + n$ have a value to produce a molecular weight of about 300 to about 2000, preferably about 600 to about 2000 and most preferably about 800 to about 1800.

21 Claims, No Drawings

OXIDATION STABLE POLYOXYALKYLENE FIBER LUBRICANTS

BACKGROUND OF THE INVENTION

1. Field of the Invention

This invention relates to lubricants for synthetic fibers such as incorporated with mono- and multi-filament polyester and nylon yarn and particularly to fiber lubricants having improved resistance to oxidative degradation at elevated temperatures of at least over 200° C. Such lubricants are suitable for use in producing a synthetic continuous filament, false twist, textured yarn as well as other yarns.

2. Description of the Prior Art

The production of yarns from organic linear synthetic polymers such as polyesters and polyamides requires the formation of a yarn by a suitable spinning method such as melt-spinning, wet-spinning or dry-spinning. Improved properties can be obtained when such yarns are heat set. In the production of so-called "bulky" yarns, the yarns must be heat-treated to set the shape of the yarn. The various thermo-treatments required are of necessity performed at very high speed as disclosed in U.S. Pat. No. 3,446,734 in which a process for the production of nylon tire cord is disclosed. In such processes yarn coated with about 1% of a so-called lubricating composition is subjected to temperatures of 180° C to 225° C during the processing.

A yarn or fiber lubricant generally must provide, in addition to lubricity, antistatic properties and emulsification or solubilization properties to enable easy removal of the lubricant from the yarn or fiber prior to the dyeing operation. In the preparation of fiber lubricant compositions, it is conventional to utilize adjuncts to the principal components of the composition such as antistatic agents, emulsifiers, oxidation stabilizers, etc.

The above lubricant properties should not be lost upon exposure of the yarn to temperatures at least above 200° C by either or both the oxidative degradation of the lubricant or the volatilization of the lubricant. Conventional lubricants for synthetic thermoplastic textile fibers generally suffer from the defect that at temperatures such as at least above 180° C the lubricants fume indicating volatilization and/or form a tar-like, resinous material. A heated metal plate which is in contact with the yarn during a part of the processing to impart better heat transfer is usually the site at which such resinous materials are deposited.

The need for oxidation resistance in a fiber lubricant is often indicated upon storage of lubricant treated fibers over prolonged periods of time. It is under such conditions that a yarn lubricant stabilized with an oxidation stabilizer such as certain phenols, aryl sulfonamides, phenothiazines, etc., will discolor usually with the formation of a characteristic color. The formation of insoluble resinous compounds and bacterial growth can also result from the use of certain yarn lubricants under such storage conditions.

The use of difunctional phenols and aromatic substituted glycidyl ethers, preferably phenyl glycidyl ethers, in the preparation of improved oxidation stable polyoxyalkylene compounds for use as fiber lubricants, wherein said oxidation stable fiber lubricants are resistant to yellowing upon exposure to an atmosphere in which oxides of nitrogen are present, is an unexpected advantage of the improved oxidation stable polyoxyalkylene fiber lubricants disclosed herein.

It is known to produce, as yarn lubricants, heteric polyoxyalkylene monoesters of stearic acid or lauric acid from U.S. Pat. No. 3,925,588 and British Pat. No. 1,460,960. Such lubricants have insufficient heat resistance and exhibit an undesirable high volatility at elevated temperatures at which they are used. It is known to produce heat stabilized polymers of alkylene oxides by mixture of phenothiazine therewith from U.S. Pat. No. 2,786,080 and U.S. Pat. No. 3,326,849. Antioxidants for polyoxyalkylene compounds are also disclosed in U.S. Pat. No. 3,146,272. Various monofuctional phenolic compounds such as phenothiazine, phenol and alkylated phenols which are known to be useful as additives to improve the oxidation stability in polyoxyalkylene compounds are utilized as initiators in the production of oxidation stable polyoxyalkylene compounds. Said phenolic compounds are useful in admixture with oxidation-susceptible polyoxyalkylene compounds wherein the alkylene radicals contain 2 to 4 carbon atoms.

Stabilized lubricants for nylon and polyester fibers are also disclosed in Japanese Pat. No. 76-70,397. In this reference there is disclosed a mixture of a polyethylene glycol castor oil ester and, as a stabilizing component, a bis propoxylated bisphenol A ether dilaurate. Esters of polyoxyalkylene diols initiated using an aliphatic dihydroxy alcohol are disclosed in U.S. Pat. No. 2,457,139 and U.S. Pat. No. 3,756,972.

The use of a difunctional phenol such as resorcinol as an initiator in the preparation of polyoxyalkylene surfactants is disclosed in U.S. Pat. No. 2,674,619. In U.S. Pat. No. 3,036,118 there is disclosed the production of conjugated polyoxyethylene-polyoxypropylene surfactants using initiators having at least two reactive hydrogen atoms. Fiber-treating compositions having improved heat resistance and reduced high temperature volatility and containing an ester of an ethoxylated aryl phenol are disclosed in U.S. Pat. No. 3,578,594. The use of aromatic substituted alkylene oxides in the production of polyoxyalkylene compounds is disclosed in U.S. Pat. No. 2,677,700.

SUMMARY OF THE INVENTION

There are disclosed improved oxidation stable polyoxyalkylene compounds which are useful either alone or in admixture with prior art, oxidation-susceptible polyoxyalkylene compounds as lubricants for synthetic textile fibers. Such lubricants are required to be applied to a textile fiber subsequent to spinning to reduce the tendency toward breakage of the individual filaments as they are subjected subsequently to various mechanical strains. These lubricants function to enable satisfactory handling of such fibers as nylon and polyester in processing applications such as spinning, twisting, winding, reeling, drafting, weaving, carding, combing, knitting, throwing and are particularly suited for use in producing a synthetic fiber continuous filament, false twist, textured yarn as well as other type yarns.

The polyoxyalkylene compound lubricants of the invention are based upon the inclusion of the residue of a difunctional phenolic compound in the polyoxyalkylene polymer chain either by use of said difunctional phenolic compound as an initiator for alkylene oxide polymerization or by the use of an aromatic substituted glycidyl ether as a component in the production of the polyoxyalkylene lubricants.

In addition to the use of the above-described compounds alone as textile fiber lubricants, it has been found that such compounds can be used in combination with a prior art polyoxyalkylene compound wherein the alkylene radicals each contain 2 to 4 carbon atoms and said compound is susceptible to oxidative deterioration to provide additional compositions suitable for use as textile fiber lubricants which have increased resistance to oxidative degradation. Specific polyoxyalkylene compounds which are susceptible to oxidative degradation when exposed to temperatures of 200° C or more are compositions such as the oxyethylene ester of stearic acid, the heteric oxyethylene-oxypropylene ester of stearic acid and the monostearate ester of heteric (oxyethylene-oxypropylene) polyalkylene compositions based upon butanol as an initiator.

Fiber lubricants of the invention based upon mixtures of polyoxyalkylene compounds of the prior art which are susceptible to oxidative deterioration and the improved oxidation stable polyoxyalkylene compounds disclosed herein can contain an effective proportion of at least about 25% by weight of said oxidation stable polyoxyalkylene compounds.

It is a primary object of this invention to provide an improved lubricant for synthetic thermoplastic textile fibers, said lubricants having improved resistance to oxidation and at the same time having resistance to discoloration upon exposure to atmospheric oxides of nitrogen.

DETAILED DESCRIPTION OF THE INVENTION AND THE PREFERRED EMBODIMENTS

The textile fiber lubricants of the invention are described in more detail below and processes for the preparation thereof are also described. The improved oxidation stable polyoxyalkylene compound lubricants of the invention are useful either alone or in admixture with the polyoxyalkylene lubricant compounds of the prior art and are generally described by the formulas:

$$R-\overset{O}{\overset{\|}{C}}-(O-R_1-O-R_2)_m-R_3-(O-R_1-O-R_2)_n-OH, \quad \text{I.}$$

$$R-\overset{O}{\overset{\|}{C}}-(O-R_1-O-R_2)_m-R_3-(O-R_1-O-R_2)_n-\overset{O}{\overset{\|}{C}}-R \quad \text{II.}$$

and $$R-\overset{O}{\overset{\|}{C}}-(O-R_1-O-R_2-O-R_5)_n-R_4 \quad \text{III.}$$

These lubricants when used in blends with polyoxyalkylene fiber lubricant compounds of the prior art are preferably used in admixture with compounds selected from the group consisting of prior art compounds having the formulas:

$$R-\overset{O}{\overset{\|}{C}}-(O-R_1)_n-OH, \quad \text{IV.}$$

$$R-\overset{O}{\overset{\|}{C}}-(O-R_1-O-R_2)_n-OH \quad \text{V.}$$

and $$R-\overset{O}{\overset{\|}{C}}-(O-R_1-O-R_2)_n-O-R_4 \quad \text{VI.}$$

in which R, $R_1$, $R_2$, $R_3$, $R_4$, $R_5$, m and n are as previously defined.

Methods for the polymerization of polyalkylene compounds are well known in the art and are described in U.S. Pat. No. 2,674,619 and U.S. Pat. No. 3,036,018, incorporated herein by reference. The polyoxyalkylene intermediate compounds so prepared which can be, for instance, homopolymers or copolymers, i.e., block or random (heteric) copolymers of ethylene oxide and 1,2-propylene oxide, and are preferably heteric copolymers thereof, wherein the ethylene oxide content is such that the weight ratio of ethylene oxide to 1,2-propylene oxide is generally, respectively 90:10 to 10:90, preferably 80:20 to 20:80 and most preferably 75:25 to 25:75. The monoesters are formed by the reaction of this intermediate polymer with an aliphatic saturated acid having a carbon chain length of about 1 to about 21 carbon atoms, preferably about 7 to about 21 carbon atoms and most preferably about 12 to about 18 carbon atoms or lower, $C_1-C_4$ alkyl ester thereof. Typically, in the preparation of the monoesters of formula I, the polyoxyalkylene polymer is reacted with an equivalent or a slight excess of the methyl ester of the desired aliphatic saturated acid. The reaction is usually carried out at temperatures up to 150° C under a vacuum of about 1 millimeter mercury until the transesterification reaction is substantially completed.

The difunctional phenols can be mononuclear or polynuclear. Representative examples of mononuclear difunctional phenols are resorcinol, catechol, and hydroquinone. Representative examples of polynuclear difunctional phenols are 2,2'-(4,4'-hydroxyphenyl) propane, 2,2'-bis(4-hydroxyphenyl) butane, 2,6-dihydroxynaphthalene and 1,4-dihydroxynaphthalene.

Representative aliphatic saturated monocarboxylic acids, the residues of which are defined herein as R in formulas I to VI, having from about 1 to about 21 carbon atoms that can be used in the esterification are acetic, propionic, butyric, valeric, caproic, caprylic acid, capric acid, lauric acid, myristic acid, palmitic acid, stearic acid, oleic acid, behenic acid, their isomers and lower alkyl esters ($C_1$ to $C_4$), their mixtures and the like. Representative corresponding radicals, or residues, are: stearoyl, lauroyl, caproyl, oleoyl, etc.

The oxidation stable polyoxyalkylene diester lubricants of the invention (II) are prepared in a similar manner to those monoester lubricants described above except that said lubricants are prepared from different alkylene units and in the esterification step, the polyoxyalkylated compound is reacted with at least 2 moles of the desired acid or acid ester for every mole of polyoxyalkylene compound to produce the desired ester. Similar saturated monocarboxylic fatty acids can be used.

The oxidation stable polyoxyalkylene compound lubricants having the formula III are prepared using a monofunctional aliphatic alcohol having 1 to about 21 carbon atoms, preferably about 8 to about 18 carbon atoms or an aliphatic monocarboxylic acid having from about 2 to about 21 carbon atoms, preferably about 8 to about 18 carbon atoms and most preferably about 6 to about 12 carbon atoms, as initiators for the production of the polyoxyalkylene compound. Useful aliphatic monofunctional alcohols include aliphatic primary alcohols such as methyl, ethyl, propyl, butyl, amyl, hexyl, heptyl, octyl, nonyl, decyl, dodecyl, tetradecyl, cetyl alcohols and corresponding secondary alcohols and their isomers, mixtures and the like. Useful monofunctional aliphatic alcohol initiators also include those alcohols produced by hydrogenation of fatty acids or glycerides from animal or vegetable oils and waxes such as coconut oil, castor oil, tallow oil, tall oil and the like. Alcohols produced by the OXO process are also useful initiators. As is well known this process involves the catalytic reaction of alpha-olefins with carbon monoxide and hydrogen under pressure to obtain primary aliphatic alcohols having branched chains. Useful OXO alcohols include isooctyl, decyl, tridecyl, pentadecyl, alcohols and their mixtures such as those sold under the trademark "NEODOL" by the Shell Chemical Company and the like. Primary aliphatic alcohols which are useful initiators also include those produced by the polymerization of ethylene with Ziegler type catalysts and subsequent reaction of the metal alkyls formed in this polymerization to obtain mixtures of straight chain primary alcohols. These alcohols can be utilized as initiators either alone or in mixtues.

As initiators, aliphatic monocarboxylic acids can be used as alternatives to the aliphatic alcohols listed above. Useful monocarboxylic aliphatic acids have carbon chain lengths of from 2 to about 21 carbon atoms, preferably about 4 to about 18 carbon atoms. Typical representative acids are acetic, propionic, butyric, lauric, caproic, caprylic, capric, myristic, palmitic, stearic, oleic and the like. Where an aliphatic monocarboxylic acid or monofunctional alcohol, as described above, is utilized as an initiator in the production of the polyoxyalkylene polymers of the invention, in order to incorporate an aromatic ring, preferably a phenyl group in the polymer chain, it is necessary to include in addition to a lower aliphatic alkylene oxide or mixture thereof selected from the group consisting of ethylene, propylene and butylene oxides, an aromatic substituted alkylene oxide such as phenyl glycidyl ether. Examples of useful aromatic substituted alkylene oxides are as follows: p-methoxy phenyl glycidyl ether, p-chlorophenyl glycidyl ether, and p-methyl phenyl glycidyl ether.

The polyoxyalkylene compounds of the invention can be either homopolymers or copolymers having regularly repeating monomer units or segregated "blocks" of different structure in the polymer chain. The molecular weight of said polyoxyalkylene compounds is about 300 to about 2000 and the weight ratio of ethylene oxide utilized to the other lower alkylene oxides such as 1,2-propylene oxide or butylene oxide is generally 90:10 to 10:90, preferably 80:20 to 20:80 and most preferably 75:25. It is desirable for certain embodiments of the fiber lubricant copolymers of the invention to maintain a ratio of ethylene oxide to other lower alkylene oxide in order that the dispersibility of the lubricant in water will be suitable for the lubricating use intended. However, additional emulsifiers can be utilized in the lubricant composition. As is well known, a textile fiber lubricant composition generally is required to have excellent scourability so as to allow easy removal of the lubricant subsequent to processing of the yarn.

Many of the compositions of the invention are of a suitably low viscosity so that application of the lubricant to the textile fiber can be effected at temperatures of about 25° C to about 70° C simply by drawing the fiber through a bath of the lubricant without diluting with water. Water dispersibility or solubility of the lubricants of the invention can be provided to permit not only ease of removal of the lubricants from the fibers but application to the fiber from aqueous solutions. Under typical conditions the amount of lubricant on the fiber, on the basis of the weight of the fiber, is an effective amount of 1% or less to obtain satisfactory lubricating properties. The fact that the lubricant is dispersible or soluble in water permits variations in the amount of lubricant to be applied to the fiber by the simple expedient of diluting the lubricant with water to the required concentration.

In the production of the polyoxyalkylene compounds of the invention which are subsequently esterified to produce lubricants of the invention, it will be appreciated that in all instances a mixture of various molecular weight polymers results and that molecular weights given throughout this application are average values.

The term "polyoxyalkylene compound", as used herein, includes compounds wherein the alkylene radicals contain a substituent radical such as phenyl, chlorine, bromine, or hydroxyl or contain olefinic unsaturation. Typical examples of such compounds include the block or heteric polyoxyalkylenes, polyepichlorohydrin, polyglycidol, poly(styrene glycol), polyoxy-1,2- or 2,3-butylenes either alone or in admixture with other polymers derived from lower alkylene oxides present in a random sequence structure (heteric) or as segregated blocks (block polymers) and the esters thereof.

Where the oxidation stable lubricants of the invention are used in admixture with prior art polyoxyalkylene compounds, such compounds are preferably selected from the group consisting of the prior art alkoxylated fatty acid esters, specifically the ethoxylated and mixed ethoxylated-propoxylated fatty acid esters. The prior art ester alkoxylates which can be used include both block or heteric alkoxylates of fatty acids as well as the polyoxyalkylenes derived from active hydrogen compound-initiated mixed alkylene oxides including both heteric or block polymers. The initiator is, for instance, an aliphatic alcohol or acid as previously described and said polyoxyalkylene compound is subsequently esterified to form an ester with a monocarboxylic aliphatic acid preferably having about 7 to about 21 carbon atoms in the alkyl chain. At least 25% by weight based upon total weight of the oxidation stable polyoxyalkylene compounds of the invention are used in such mixtures.

It is believed that the oxidative deterioration of polyoxyalkylene compounds of the prior art is accompanied by the formation of carbonyl compounds, peroxides and acids and the manifestation of such deterioration is formation of color. Often, a decrease in viscosity and the formation of volatile by-products as indicated by fuming of the composition at elevated temperature occurs. The tendency to fume of textile lubricants upon use at elevated temperature is commonly used as an indication of the oxidation stability of the lubricant. It is, therefore, common to evaluate the oxidation stability of such products by thermogravimetric analysis. For instance, evaluation of oxidation stability of products shown in the examples which follow was accomplished by utilizing a Du Pont Model 990 Thermoanalyzer.

Both dynamic and isothermal evaluations were conducted to determine the oxidation stability of the textile lubricants of the invention. In the dynamic method of evaluation, the sample is heated at a rate of 10° C per minute while exposed to a compressed air flow at a flow rate of 50 milliliters per minute. The temperature is recorded after the sample has lost 1% of its original weight. In the isothermal method of evaluating oxidation stability, the sample is placed in the oven of the thermal analyzer referred to above, the oven being preheated to 220° C, held at this temperature for 30 minutes while exposed to compressed air flowing at the rate of 50 milliliters per minute and the weight loss in percent at the end of the 30-minute interval is recorded.

Another method of evaluating the oxidation stability of the textile lubricants of the invention is to determine the thin film smoke point of the lubricant. In this test method, approximately 0.5 gram of the lubricant is spread evenly into a milled depression on the top surface of a steel block. The block is then heated at the rate of 10° C per minute and the temperature at which the first smoke is observed at the surface of the sample is recorded as the thin film smoke point.

The preferred polyester fibers are produced from the linear terephthalate polyesters, that is, the polyesters of a glycol containing from 2 to 20 carbon atoms and a dicarboxylic acid component containing at least about 75% terephthalic acid. The remainder, if any, of the dicarboxylic acid component may be any suitable dicarboxylic acid such as sebacic acid, adipic acid, isophthalic acid, sulfonyl 4,4'-benzoic acid or 2,8-dibenzofuran dicarboxylic acid. The glycols used can contain 2 or more than 2 carbon atoms in the chain, for instance, ethylene glycol, diethylene glycol, butylene glycol, decamethylene glycol and bis(1,4-hydroxy methyl) cyclohexane. Examples of linear, terephthalate polyesters which can be employed include poly(ethylene terephthalate) and poly(butylene terephthalate).

Any suitable nylon polymer which provides high tenacity yarn can be utilized in combination with the lubricants of the invention to produce false twist or high bulk yarn. The preferred nylon fibers are those produced from the following polymers: poly(hexamethylene adipamide) and poly(caprolactam).

Utilization of the fiber lubricants of the invention can be in any conventional spin-drawing process or in a separate drawing process available in the prior art. The treatment of the synthetic fibers with the fiber lubricants of the invention can be effected by any method practiced in the prior art to provide lubrication. Usually, the treating agent of the invention is applied to the fibers as an aqueous emulsion having a concentration of 2 to 30% by weight. Sufficient lubricity is obtained with a dry weight add-on of the treating lubricant of usually about 0.05% to about 3.0%, preferably about 0.2% to about 1.0%, by weight based upon the weight of the thermoplastic, synthetic fibers. The temperature at which the fibers are heat-treated usually ranges from 150° C to 320° C, preferably above 200° C. The fiber lubricants of the invention provide especially satisfactory lubrication and resistance to oxidation over the temperature range of 200° C to 230° C.

The invention is further illustrated by the following examples. Where not otherwise specified throughout the specification and claims, pressure is in pounds per square inch gauge, temperatures are given in degrees centigrade and parts, percentages and proportions are by weight.

EXAMPLE 1

This example illustrates the preparation of a fiber lubricant of the invention which is the stearate ester of a hydroquinone-initiated heteric polymer consisting of 75% ethylene oxide and 25% propylene oxide by weight.

A polyoxyalkylene intermediate was prepared by adding two moles of di(β-hydroxyethyl) hydroquinone to an autoclave equipped with temperature, pressure and vacuum controls. The hydroquinone was melted under a nitrogen atmosphere at a temperature of 105° C to 110° C. Thereafter, 10 grams of a 90% potassium hydroxide solution were added and the autoclave heated to 125° C after evacuating to a vacuum of less than 10 millimeters of mercury. The vacuum was broken after the removal of 6 grams of volatiles and nitrogen was added to give a pressure of 3—7 pounds per square inch guage. A mixture of 9.9 moles of propylene oxide and 39.2 moles of ethylene oxide was then added over a period of about 6½ hours. The mixture was held an additional 2 hours at 125° C to insure complete reaction and then the polyoxyalkylene intermediate was recovered and found to have a hydroxyl number of 96.2.

The stearate ester of this intermediate was prepared by transesterification. The polyoxyalkylene intermediate was added in the amount of 1.1 moles to a 3-liter flask equipped with a means for stirring, distillation apparatus and temperature control means. The intermediate was heated to 130° C and volatiles removed by vacuum. Methyl stearate in the amount of 0.6 mole was then added and the flask evacuated to less than 10 millimeters of mercury and the temperature held at 130° C for about 80 minutes. Sodium methoxide in the amount of 0.5 gram was added as a catalyst and the transesterification reaction was allowed to proceed at a vacuum of less than 10 millimeters of mercury at a temperature of 130° C for an additional 105 minutes. The balance of methyl stearate, 0.5 mole was then added and the flask was evacuated to remove volatiles. After 60 minutes additional sodium methoxide in the amount of 0.5 gram was added and the reaction continued at a vacuum of less than 10 millimeters of mercury at a temperature of 130° C for an additional 105 minutes. The product obtained was deionized and the desired monostearate ester of the ethoxylated propoxylated hydroquinone-initiated polymer was obtained having a hydroxyl number of 42.3 (theoretical 38.1), an acid number of 1.32, a sodium ion concentration of 34.5 parts per million by weight and a potassium ion concentration of 5.5 parts per million by weight.

EXAMPLE 2

This example illustrates the preparation of the stearate ester of a hydroquinone-initiated heteric propylene oxide-ethylene oxide polymer having a weight ratio respectively of 70 propylene oxide and 30 ethylene oxide. The proportions and procedures of Example 1 were repeated to prepare a fiber lubricant of the invention (having a theoretical number of 37.8) except that the deionizing process of Example 1 was eliminated and the crude product was reacted with sufficient acetic acid to neutralize the base catalyst used.

EXAMPLE 3

The procedure of Example 1 was repeated except that the polyoxyalkylene intermediate has a weight ratio of 70 parts of ethylene oxide and 30 parts propylene oxide. The crude product was deionized to remove the base catalyst. The product had a hydroxyl number of 40.7 (theoretical 37.8) and an acid number of 0.5.

EXAMPLE 4

This example illustrates the preparation of the laurate ester of a resorcinol-initiated heteric polyoxyalkylene compound having a weight ratio of 70 parts propylene oxide and 30 parts ethylene oxide. The same procedure and proportions are utilized as described in Example 2. The product obtained had a hydroxyl number of 52 (theoretical 38.7) and an acid number of 7.8.

EXAMPLE 5

Example 4 was repeated except that a transesterification reaction utilizing methyl stearate was performed in order to obtain the stearate ester of a resorcinol-initiated heteric polyoxyalkylene having 70 parts propylene oxide and 30 parts ethylene oxide by weight. The product had a hydroxyl number of 44.5 (theoretical 36.6) and an acid number of 6.4.

EXAMPLE 6

The procedure and proportions of Example 4 were repeated except that the resorcinol-initiated heteric polyoxyalkylene intermediate had a 75 parts ethylene oxide and 25 parts propylene oxide weight ratio and the base catalyst was removed by a deionization process. The product had a hydroxyl number of 51 (theoretical value of 40.2), an acid number of 1.6, a sodium ion concentration of 114 parts per million and a potassium ion concentration of 17 parts per million by weight.

EXAMPLE 7

Following the procedure of Example 1, a fiber lubricant was prepared consisting of the laurate ester of a hydroquinone-initiated heteric polymer consisting of 70 parts of propylene oxide by weight and 30 parts of ethylene oxide by weight. The crude product was deionized to remove the base catalyst giving the desired lubricant. Hydroxyl number was found to be 57.6 (theoretical value 41.4), the acid number was 1.2, the sodium ion concentration was 92 parts per million by weight and the potassium ion concentration was 1.2 parts per million by weight.

EXAMPLE 8

In accordance with the procedure of Example 1, a fiber lubricant was prepared consisting of the stearate ester of a resorcinol-initiated heteric polymer containing 75 parts ethylene oxide by weight and 25 parts propylene oxide by weight. The desired lubricant was found to have a hydroxyl number of 47.0 (theoretical 38.3) and an acid number of 0.6.

EXAMPLE 9

In accordance with the procedure of Example 1, a fiber lubricant consisting of the laurate ester of a hydroquinone-initiated heteric polymer containing 75 parts ethylene oxide by weight and 25 parts propylene oxide by weight was prepared. The crude lubricant product, after deionization to remove the base catalyst, had a hydroxyl number of 47.2 (theoretical value 40.7), an acid number of 1.7, a sodium ion concentration of 99 parts per million and a potassium ion concentration of 11 parts per million by weight.

EXAMPLE 10 (Comparative Example)

For comparative purposes, a fiber lubricant of the prior art forming no part of this invention was prepared by adding by weight 75 parts ethylene oxide and 25 parts propylene oxide to stearic acid in accordance with the teaching of U.S. Pat. No. 3,925,588 and British Pat. No. 1,460,960. The final product was deionized to remove the base catalyst and obtain a product having a molecular weight of approximately 1400, a hydroxyl number of 40.7, an acid number of 0.71, a sodium ion concentration of 19.2 parts per million by weight and a potassium ion concentration of 3.6 parts per million by weight.

EXAMPLE 11 (Comparative Example)

A refined coconut oil available commercially under the trademark "COBEE 76" from PVO International Incorporated was utilized for comparative purposes in the test following. A typical analysis of the product is as follows: iodine value - 9, saponification value — 255, lauric acid - 48% by weight and unsaturated fatty acid - 8% by weight.

EXAMPLE 12 (Comparative Example)

The fiber lubricant of Example 10, which is not a part of this invention, was heat stabilized by the addition of 3% of a commercial antioxidant sold under the trademark "TOPANOL CA". This material is available commercially from ICI United States Incorporated and is described as a phenol condensation product.

EXAMPLE 13 (Comparative Example)

The fiber lubricant of Example 10, forming no part of this invention, was stabilized by adding 1.5% of the phenol condensation product sold under the trademark "TOPANOL CA".

EXAMPLE 14 (Comparative Example)

The fiber lubricant of Example 10, forming no part of this invention, was stabilized by the addition of 1% of a phenol condensation product sold under the trademark "TOPANOL CA".

EXAMPLE 15

A mixture of 25 parts by weight and 75 parts by weight, respectively, of a lubricant of the invention, Example 8, and a prior art lubricant, Example 10, was made and evaluated for heat stability by thermogravimetric analysis. One percent weight loss occurred at 239° C; 14% weight loss occurred after heating at 220° C for ½ hour. This compares with 228° C and 31.5% weight loss for the prior art lubricant of Example 10.

EXAMPLE 16

A mixture of 25 parts by weight and 75 parts by weight of the lubricants of Examples 1 and 10, respectively, was made and evaluated for heat stability as in Example 15. One percent weight loss occurred at 232° C; 21.5% weight loss occurred after heating for ½ hour at 220° C.

EXAMPLE 17

The lubricant of Example 8 was applied by the following procedure to a scoured polyester yarn produced by Hoechst and identified as 150/32/1/42/SD using the Atlas Yarn Finish applicator. About 0.6% by weight (dry basis) of lubricant was added to the yarn based upon the weight of the yarn.

EXAMPLE 18

The procedure of Example 17 was repeated using the lubricant of Example 1.

In order to evaluate the physical properties of the lubricants of the invention, the following test methods were utilized. The heat stability of the lubricants of the invention was evaluated by thermogravimetric analysis in which a standard quality of fiber lubricant was heated from a temperature of 25° C at the rate of 10° C per minute until 1% weight loss was obtained. The temperature at this point is recorded as the dynamic heat resistance of the lubricant. A second method of evaluating the heat resistance of the lubricants of the invention was by heating 60 milligrams of lubricant at a temperature of 220° C for a period of 30 minutes. The percent weight loss is recorded and is termed the "isothermal heat resistance" of the sample.

Not only weight loss at elevated temperature is important in a fiber lubricant but the remaining lubricant or residue subsequent to volatilization of a portion of the lubricant is of interest. Therefore, residue formation in the lubricants of the invention was evaluated by heating 0.2 gram of the lubricant for a period of 8 hours at a temperature of 220° C in a circulating air oven. The proportion of residue remaining and the nature of the residue is recorded in this test.

A third test designed to evaluate the heat resistance of the fiber lubricants of the invention is the thin film smoke point test. In this procedure, 0.5 gram of lubricant is heated at the rate of 10° C per minute until smoke is first observed rising from the surface of the sample. The temperature is recorded as the smoke point.

In order to demonstrate the resistance of the fiber lubricants of the invention to discoloration upon exposure to oxides of nitrogen, a nylon fabric was treated with approximately 1% of various lubricants of the invention as well as certain prior art lubricant compositions and exposed to oxides of nitrogen in accordance with test method AATCC 75-1956 entitled "Color Fastness to Oxides of Nitrogen in the Atmosphere: Rapid Control Test".

Finally, the coefficient of friction (f) of scoured yarn to metal was determined as follows: The yarn was prepared for testing by applying the lubricant to the yarn on an apparatus made by the Precision Machine and Development Company which is entitled "Atlas Yarn Finish Applicator". In this machine, the yarn is passed at a controlled speed through a continually replenished drop of lubricant dispersed or dissolved in water. The solution is metered to the application area of the machine by an adjustable syringe pump so as to apply about 0.6% by weight lubricant (dry basis) to the yarn which is then led from the feeder globule over an adjustable canter roller which spaces the yarn for passage over the drying drum for removable of water and finally onto a winding tube. Prior to testing for the coefficient of friction, the yarn was conditioned overnight at 65% relative humidity and 70° F.

The coefficient of friction (f) was determined using a Rothschild F-Meter by passing the yarn over a 0.313-inch diameter satin-chrome pin using a contact angle of 180° and a yarn speed such as 100, 200 or 300 meters per minute. Tensiometers measured the yarn tension before and after its passage over the friction pin. The input tension was maintained at a value of 12 grams.

In the evaluation of the coefficient of friction of yarn to metal by the Rothschild F-Meter approximately 1500 meters of yarn are passed over the friction pin to obtain a reported f value. Thus at 300 meters per minute, the evaluation would be carried out for approximately 5 minutes to obtain the average value of f from the instrument chart. At slower speeds the evaluation was carried out over a proportionally longer time.

Table I

HEAT STABILITY OF LUBRICANTS OF THE INVENTION HAVING A POLYOXYALKYLENE RATIO OF 75 ETHYLENE OXIDE AND 25 PROPYLENE OXIDE

| | | Thermogravimetric Analysis | | | | |
|---|---|---|---|---|---|---|
| | | Dynamic | Isothermal | Smoke | Residue after 8 Hours | Nature |
| Example | Variable | ° C at 1% Weight Loss | % Weight Loss at 220° C - ½ Hour | Point (° C) | at 220° C % Weight | of Residue |
| | Stearate Ester | | | | | |
| 1 | Hydroquinone Initiator | 230 | 3.5 | 204 | 27.1 | Liquid |
| 8 | Resorcinol Initiator | 255 | 5.9 | 192 | 11.6 | Varnish |
| | Laurate Ester | | | | | |
| 6 | Resorcinol Initiator | 222 | 7.8 | 193 | 30.8 | Liquid |
| 9 | Hydroquinone Initiator | 250 | 4.4 | 200 | 45.6 | Liquid |
| | Resorcinol Initiated | | | | | |
| 8 | Stearate Ester | 255 | 5.9 | 192 | 11.6 | Varnish |
| 6 | Laurate Ester | 222 | 7.8 | 193 | 30.8 | Liquid |
| | Hydroquinone Initiated | | | | | |
| 1 | Strearate Ester | 230 | 3.5 | 204 | 27.1 | Liquid |
| 9 | Laurate Ester | 250 | 4.4 | 200 | 45.6 | Liquid |

Table II

HEAT STABILITY OF LUBRICANTS OF THE INVENTION HAVING VARIOUS RATIOS OF ETHYLENE OXIDE (EO) AND PROPYLENE OXIDE (PO)

| | | Thermogravimetric Analysis | | | | |
|---|---|---|---|---|---|---|
| | | Dynamic | Isothermal | Smoke | Residue after 8 Hours | Nature |
| Example | Variable | ° C at 1% Weight Loss | % Weight Loss at 220° C - ½ Hour | Point (° C) | at 220° C % Weight | of Residue |
| | Resorcinol-Initiated Stearate Ester | | | | | |
| 8 | 75 EO/25 PO | 255 | 5.9 | 192 | 11.6 | Varnish |
| 5 | 70 PO/30 EO | 260 | 2.5 | 216 | 39.0 | — |
| | Hydroquinone-Initiated Laurate Ester | | | | | |
| 9 | 75 EO/25 PO | 250 | 4.4 | 200 | 45.6 | Liquid |
| 7 | 70 PO/30 EO | 238 | — | 198 | 20.1 | Liquid |

Table III

HEAT STABILITY OF COMPARATIVE EXAMPLES OF PRIOR ART LUBRICANTS

| Example | Composition | Thermogravimetric Analysis Dynamic ° C at 1% Weight Loss | Thermogravimetric Analysis Isothermal % Weight Loss at 220° C - ½ Hour | Smoke Point (° C) | Residue after 8 Hours at 220° C % Weight | Nature of Residue |
|---|---|---|---|---|---|---|
| 10 | 75 EO/25 PO Heteric Stearic Acid Ester | 228 | 31.5 | 177 | 0.4 | Varnish |
| 11 | Refined Coconut Oil | 278 | — | 198 | 21.7 | Varnish |
| 12 | Example 10 + 3% Antioxidant | 297 | — | — | — | — |
| 14 | Example 10 + 1% Antioxidant | 276 | — | — | — | — |

Table IV

FRICTIONAL PROPERTIES ON POLYESTER YARN OF LUBRICANT OF THE INVENTION

| Example | Tension Speed Meters/Min. | Coefficient of Friction (f)[1] |
|---|---|---|
| Control (no lubricant) | 100 | 0.66 |
| | 200 | 0.70 |
| 8 | 100 | 0.57 |
| | 200 | 0.61 |
| 1 | 100 | 0.62 |
| | 200 | 0.63 |

[1]Rothschild F - Meter

Upon evaluating lubricants of the invention described in Examples 2, 3, and 6 through 9 for resistance to discoloration upon exposure to oxides of nitrogen, no color was found to develop. Example 10, representative of a lubricant of the prior art having poor heat resistance, also showed no color formation. A similar evaluation of Examples 12, 13 and 14, representing the prior art lubricant of Example 10 with varying amounts of antioxidant, showed brown spots on the fabric.

While this invention has been described with reference to certain specific embodiments, it will be recognized by those skilled in the art that many variations are possible without departing from the scope and spirit of the invention.

The embodiments of the invention in which an exclusive property or privilege is claimed are defined as follows:

1. A lubricant for synthetic fibers comprising a polyoxyalkylene lubricant compound having the formula:

$$R-\overset{O}{\overset{\|}{C}}-(O-R_1-O-R_2)_m-R_3-(O-R_1-O-R_2)_n-OH$$

wherein R is an alkyl group having 1 to about 21 carbon atoms, $m + n$ has a value to produce a molecular weight of about 300 to about 2000, $R_1$ and $R_2$ are the residues of the same or different alkylene units derived from alkylene oxides individually selected from the group consisting of ethylene oxide, propylene oxide, butylene oxide and an aromatic glycidyl ether and $R_3$ is the residue of a difunctional phenol.

2. The compound of claim 1 wherein $R_3$ is the residue of hydroquinone.

3. The compound of claim 1 wherein $R_3$ is the residue of resorcinol.

4. The compound of claim 2 wherein said polyoxyalkylene compound is a heteric mixture of ethylene oxide and propylene oxide having a respective weight ratio of 75:25.

5. The compound of claim 4 wherein R is stearoyl.

6. The compound of claim 4 wherein R is lauroyl.

7. The compound of claim 2 wherein said polyoxyalkylene compound is a heteric mixture of the residue of alkylene units derived from ethylene oxide and propylene oxide having a weight ratio of 70 ethylene oxide to 30 propylene oxide and R is stearoyl.

8. The compound of claim 3 wherein said polyoxyalkylene compound is a heteric mixture of the residue of alkylene units derived from ethylene oxide and propylene oxide having a weight ratio of ethylene oxide to propylene oxide of 30:70.

9. The compound of claim 8 wherein R is lauroyl.

10. The compound of claim 8 wherein R is stearoyl.

11. The compound of claim 3 wherein said polyoxyalkylene compound is a heteric mixture of the residue of alkylene units derived from ethylene oxide and propylene oxide having a weight ratio of ethylene oxide to propylene oxide of 75:25, respectively.

12. The compound of claim 11 wherein R is lauroyl.

13. The compound of claim 11 wherein R is stearoyl.

14. The compound of claim 2 wherein said polyoxyalkylene compound is a heteric mixture of the residue of alkylene units derived from ethylene oxide and propylene oxide having a weight ratio of ethylene oxide to propylene oxide of 30:70, respectively, and R is lauroyl.

15. A lubricant for synthetic fibers comprising a polyoxyalkylene lubricant compound having the formula:

$$R-\overset{O}{\overset{\|}{C}}-(O-R_1-O-R_2)_m-R_3-(O-R_1-O-R_2)_n-\overset{O}{\overset{\|}{C}}-R$$

wherein R is individually selected from alkyl groups having 1 to about 21 carbon atoms, $R_1$ and $R_2$ are the residues of different alkylene units derived from alkylene oxides individually selected from the group consisting of ethylene oxide, propylene oxide, butylene oxide and an aromatic glycidyl ether, $R_3$ is the residue of a difunctional phenol and $m + n$ has a value to produce a molecular weight of about 300 to about 2000.

16. A lubricant for synthetic fibers comprising a polyoxyalkylene compound having the formula:

$$R-\overset{O}{\overset{\|}{C}}-(O-R_1-O-R_2-O-R_5)_n-R_4$$

wherein R is an alkyl group having 1 to about 21 carbon atoms, $R_1$ and $R_2$ are the residues of the same or different alkylene units individually selected from the group consisting of the residue of ethylene oxide, propylene oxide, butylene oxide and an aromatic glycidyl ether, $R_5$ is the residue of an aromatic glycidyl ether, $R_4$ is hydrogen, an alkyl group derived from an aliphatic monofunctional alcohol having 1 to about 21 carbon atoms or an acyl group derived from an aliphatic monocarboxylic acid having about 2 to about 21 carbon atoms and n has a value to produce a molecular weight of about 300 to about 2000.

17. A composition useful as a lubricant for synthetic filaments or yarn comprising a mixture of an effective proportion of at least about 25% by weight based on the total weight of the mixture of a first polyoxyalkylene lubricant compound selected from the group consisting of a compound or mixtures thereof having the formulas:

$$R-\overset{O}{\overset{\|}{C}}-(O-R_1-O-R_2)_m-R_3-(O-R_1-O-R_2)_n-OH, \quad \text{I.}$$

$$R-\overset{O}{\overset{\|}{C}}-(O-R_1-O-R_2)_m-R_3-(O-R_1-O-R_2)_n-\overset{O}{\overset{\|}{C}}-R \quad \text{II.}$$

and $$R-\overset{O}{\overset{\|}{C}}-(O-R_1-O-R_2-O-R_5)_n-R_4 \quad \text{III.}$$

and a second polyoxyalkylene compound selected from the group consisting of a lubricant compound or mixtures thereof having the formulas:

$$R-\overset{O}{\overset{\|}{C}}-(O-R_1)_n-OH, \quad \text{IV.}$$

$$R-\overset{O}{\overset{\|}{C}}-(O-R_1-O-R_2)_n-OH \quad \text{V.}$$

and $$R-\overset{O}{\overset{\|}{C}}-(O-R_1-O-R_2)_n-O-R_4 \quad \text{VI.}$$

wherein R is individually selected from alkyl groups having 1 to about 21 carbon atoms, $R_1$ and $R_2$ in lubricants I, III, V and VI are the residues of the same or different and in lubricant II different alkylene units individually selected from the residues of ethylene oxide, propylene oxide, butylene oxide, and an aromatic glycidyl ether, $n$ or $n + m$ is of a value to produce a molecular weight of about 300 to about 2000, $R_3$ is the residue of a difunctional phenol, $R_4$ is hydrogen or an alkyl group having 1 to about 21 carbon atoms derived from an aliphatic monofunctional alcohol or an aliphatic monocarboxylic acid having 2 to about 21 carbon atoms and $R_5$ is the residue of an aromatic glycidyl ether.

18. The process of inhibiting the oxidation of a polyoxyalkylene lubricant compound when exposed to heating conditions of at least 200° C comprising maintaining in admixture with said compound an effective amount of at least about 25% by weight based on the total weight of the mixture of the compound of claim 1.

19. A lubricated polyester yarn comprising a polyester yarn and coated thereon a fiber lubricant compound comprising a polyoxyalkylene lubricant compound having the formula:

$$R-\overset{O}{\overset{\|}{C}}-(O-R_1-O-R_2)_m-R_3-(O-R_1-O-R_2)_n-OH$$

wherein R is an alkyl group having 1 to about 21 carbon atoms, $m + n$ has a value to produce a molecular weight of about 300 to about 2000, $R_1$ and $R_2$ are the residues of the same or different alkylene units derived from alkylene oxides individually selected from the group consisting of ethylene oxide, propylene oxide, butylene oxide and an aromatic glycidyl ether and $R_3$ is the residue of a difunctional phenol.

20. The article of claim 19 wherein in said lubricant compound, R is stearoyl, $R_3$ is the residue of hydroquinone and wherein said polyoxyalkylene compound is a heteric mixture of ethylene oxide and propylene oxide having a respective weight ratio of 75:25.

21. The article of claim 19 wherein in said lubricant compound, R is stearoyl, $R_3$ is the residue of resorcinol and and wherein said polyoxyalkylene compound is a heteric mixture of ethylene oxide and propylene oxide having a respective weight ratio of 75:25.

* * * * *